United States Patent [19]

Spillson

[11] 4,094,457

[45] June 13, 1978

[54] COLLAPSIBLE DRUM-TYPE CONTAINER

[75] Inventor: George A. Spillson, Monroe, Mich.

[73] Assignee: Consolidated Packaging Corporation, Monroe, Mich.

[21] Appl. No.: 842,590

[22] Filed: Oct. 17, 1977

[51] Int. Cl.[2] ..... B65D 3/02; B65D 5/00

[52] U.S. Cl. ..... 229/21; 229/1.5 B; 229/41 C; 229/61

[58] Field of Search ..... 229/21, 41 C, 1.5 B, 229/61

[56] References Cited

U.S. PATENT DOCUMENTS

| | | | |
|---|---|---|---|
| 404,585 | 6/1889 | Wright | 229/21 UX |
| 426,774 | 4/1890 | Claussen | 229/61 |
| 1,129,130 | 2/1915 | Shaw | 229/1.5 B X |
| 1,486,043 | 3/1924 | Schwartz | 229/61 |
| 1,555,054 | 9/1925 | Berkowitz | 229/41 C |
| 1,957,402 | 5/1934 | Abramson | 229/61 |
| 2,232,088 | 2/1941 | Waters | 229/21 X |
| 2,240,599 | 5/1941 | Amberg | 229/1.5 B |
| 3,317,118 | 5/1967 | Harrison et al. | 229/21 X |
| 4,020,988 | 5/1977 | Kipp | 229/21 X |

FOREIGN PATENT DOCUMENTS

| | | | |
|---|---|---|---|
| 1,065,320 | 9/1959 | Germany | 229/61 |
| 41,779 | 10/1937 | Netherlands | 229/61 |

*Primary Examiner*—Davis T. Moorhead

*Attorney, Agent, or Firm*—Hugh Adam Kirk

[57] ABSTRACT

A single substantially rectangular blank of fiberboard-type sheet material folded along longitudinal and central transverse triangular creases or score lines to form an open top and closed bottom substantially polygonal, such as octagonal, prism-shaped container. The straight fold lines between the bottom triangular and side rectangular panels alternately angle of about 10° with respect to each other successively around the bottom or base of the container, and the two opposite triangular double-thickness flaps extending from adjacent pairs of opposite side panels fold under the bottom so that their apeces substantially touch each other and said triangular flaps are attached to the bottom either by a staple means or an adhesive or both. The angular fold edges around the periphery of the base insure ample space under the container for these triangular flaps so the container when sitting on its base will rest primarily on alternate peripheral corners of the base, insuring its stable vertical condition. Diametrically opposite sides of the container along edges of one of the panels are flaps which are adhered by adhesive to adjacent panels to seal the opposite adjoining sidewalls of the blank and permit the collapse of the blank until ready for use by being set-up with bottom triangular flaps folded under and fastened to the bottom of the set-up container.

19 Claims, 10 Drawing Figures

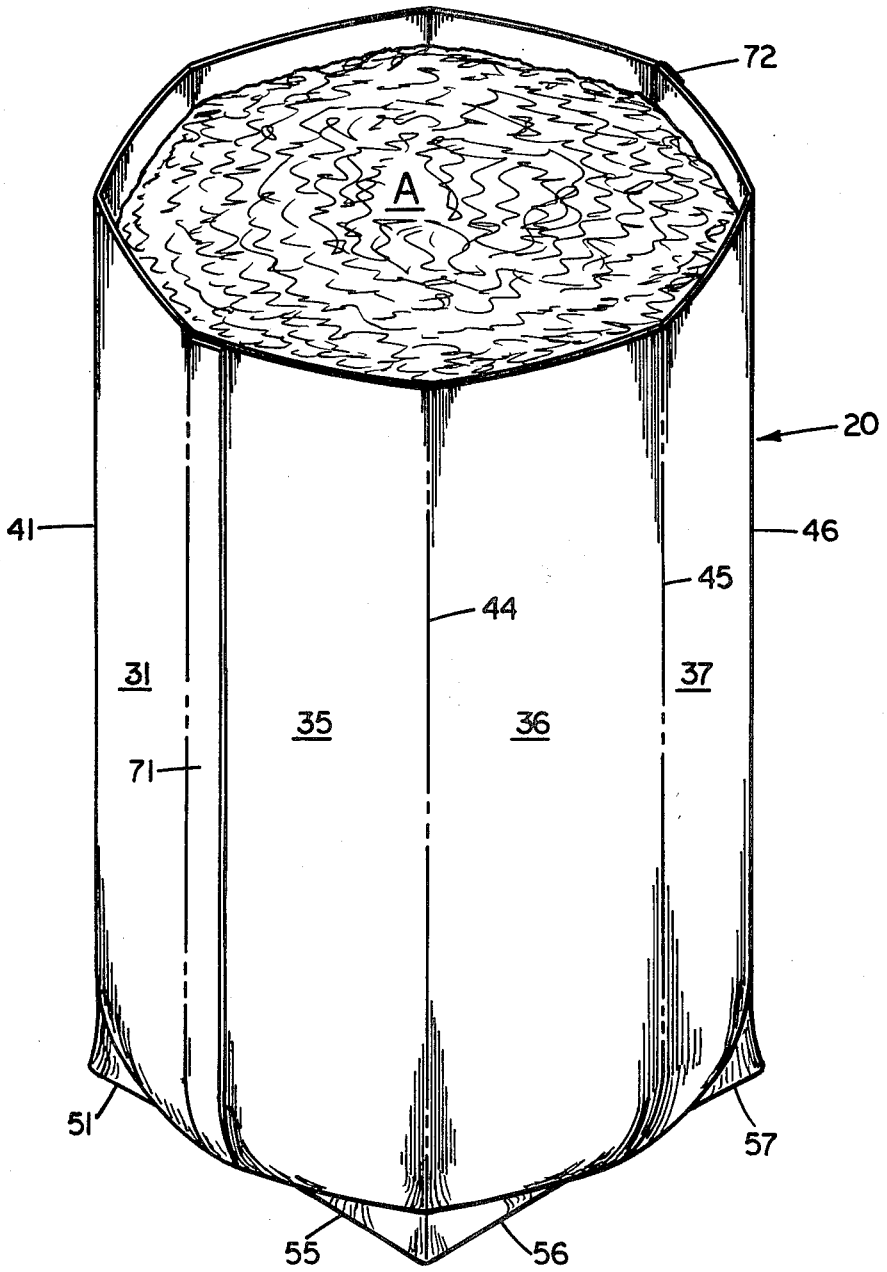
FIG. I

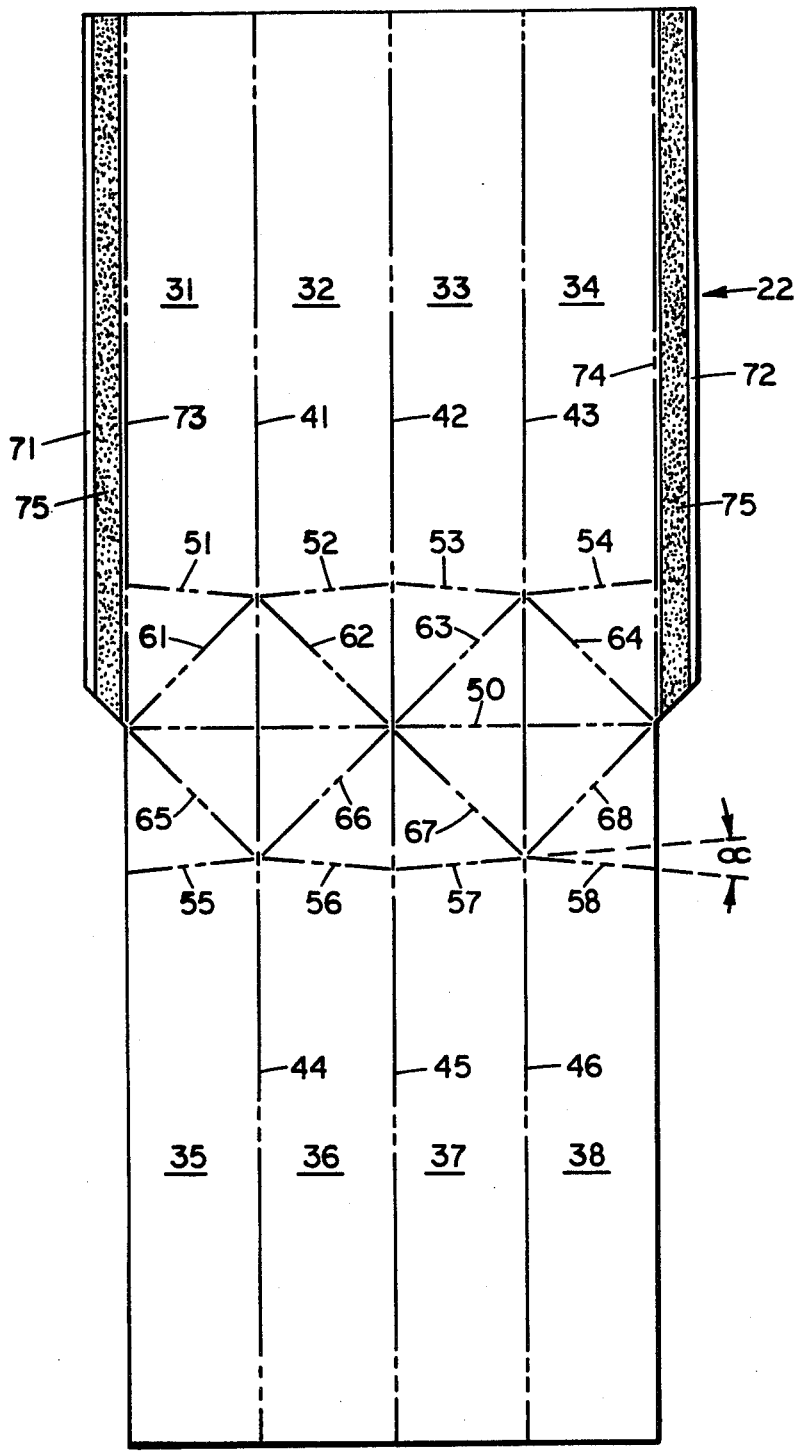
FIG. II

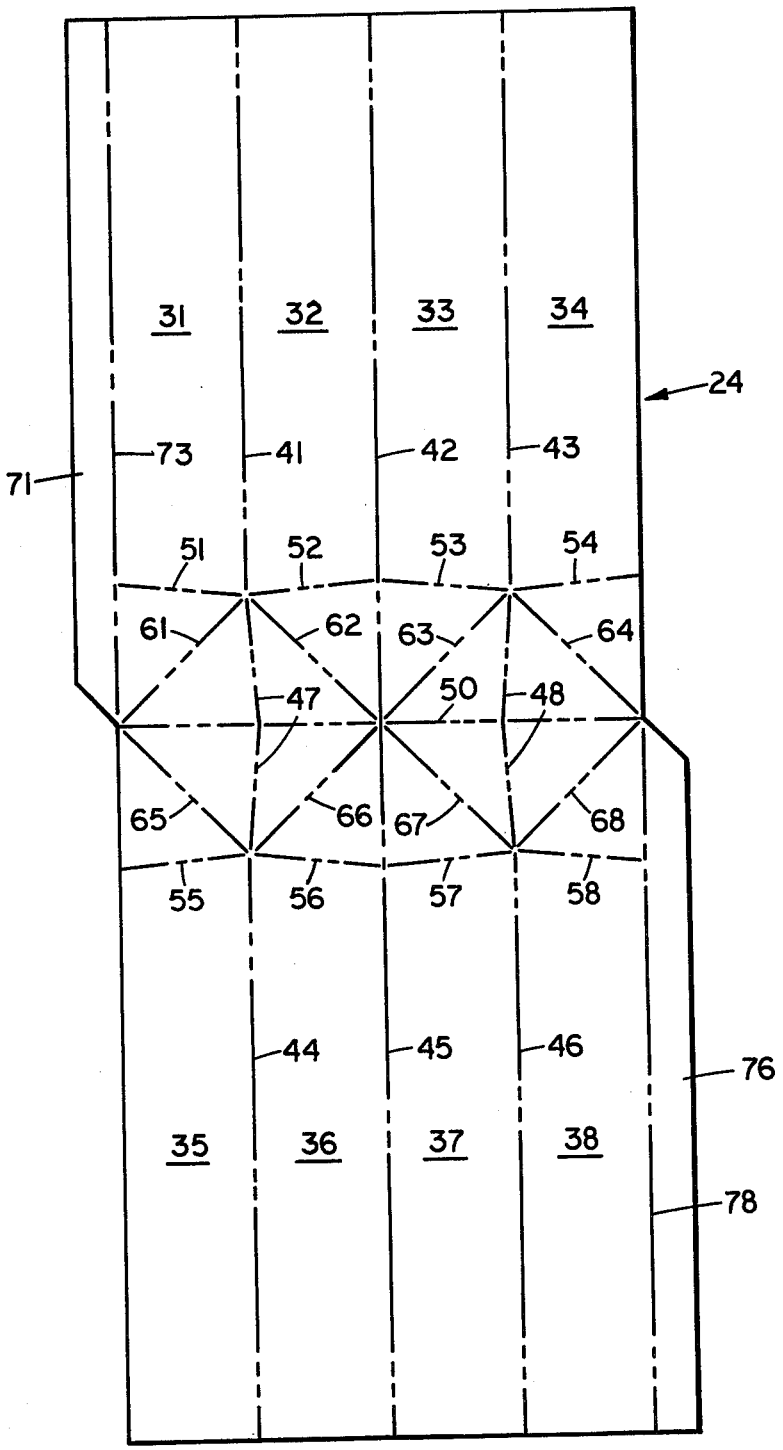
FIG. III

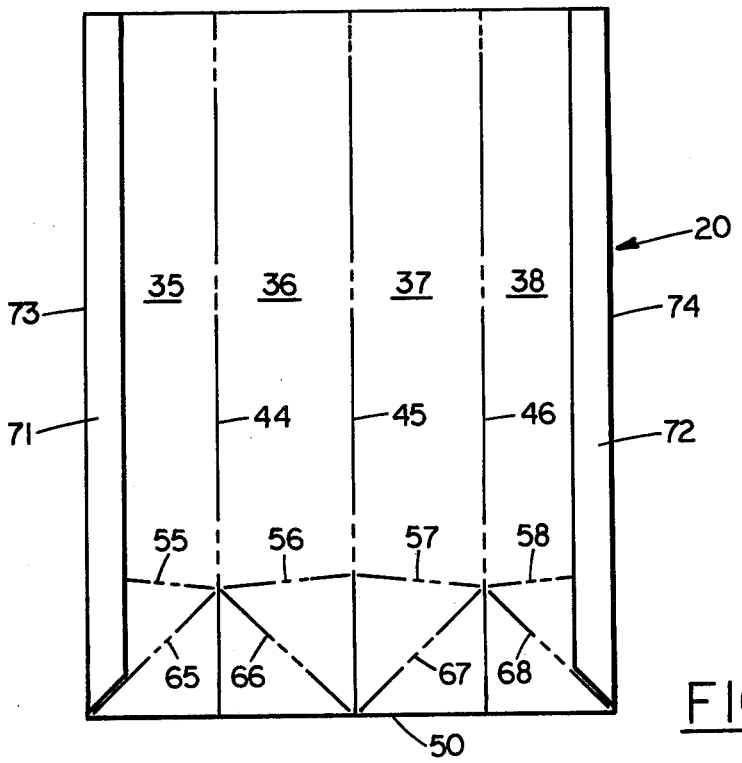
FIG. IV
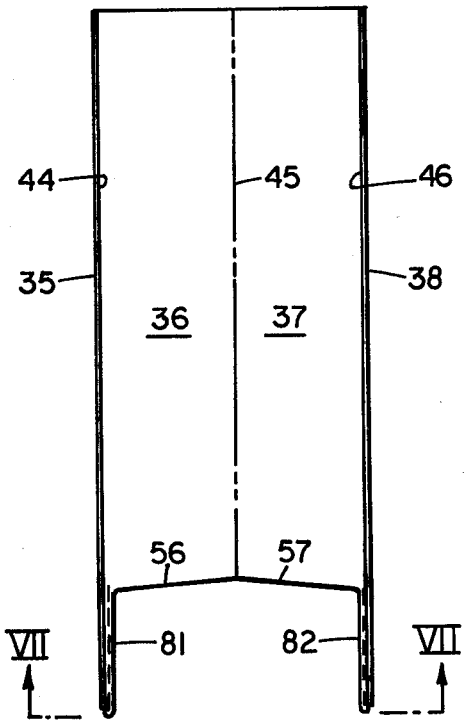
FIG. V
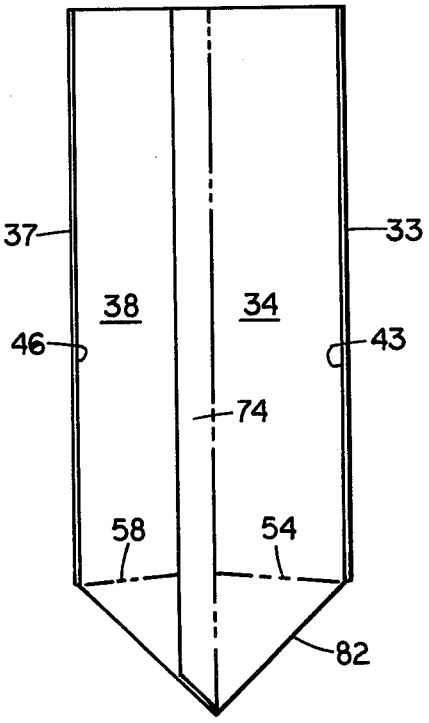
FIG. VI

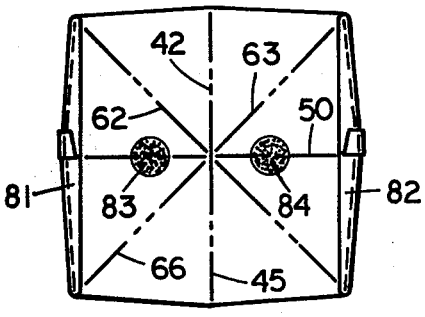
FIG. VII
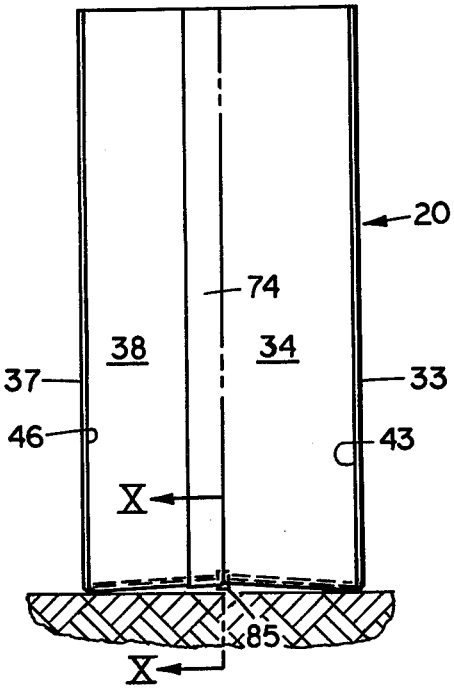
FIG. VIII
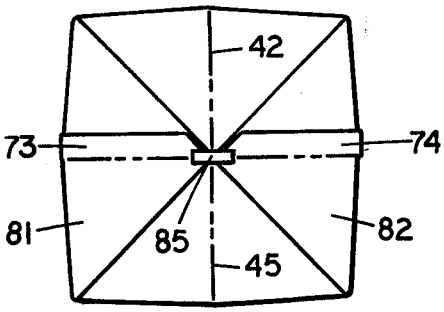
FIG. IX
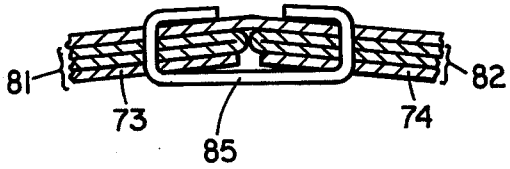
FIG. X

COLLAPSIBLE DRUM-TYPE CONTAINER

BACKGROUND OF THE INVENTION

Although the container of this invention once assembled and set-up looks similar to a grocery bag, its structure is very different in that it is not formed of a tubular blank with a folded-over open end, but instead has a folded closed bottom and sealed opposite sides, thus forming a much more liquid leak-proof container such as may be employed in holding hot asphalt until it is solidified and can be transported therein.

Usually drum-type containers for hot asphalt were formed of tubes with separate bottoms which had to be set-up on special assembling machines provided at the place they were filled, plus the fact that special metal ribs, staples, joints and/or crimps had to be used between the separate bottoms and the tubular sides to prevent leaking until the asphalt had solidified.

A closed bottom collapsible square box is shown in Schwartz U.S. Pat. No. 1,486,043, but in its collapsed position the opposite sides of the box are folded inwardly on each other and the bottom triangular tabs extend outwardly instead of forming a neat space-saving rectangular slab. Furthermore, there is no alternate angular positioning of the bottom peripheral fold line to provide stability for the box when the triangular flaps are folded thereunder in its set-up position.

A closed bottom cylindrical container is shown in Waters U.S. Pat. No. 2,232,088, but it has no longitudinal fold lines at the joints between flat side panels for easy set-up.

SUMMARY OF THE INVENTION

Generally speaking, the open top and closed bottom vertical prism-shaped container according to this invention, is made out of a single piece of flexible or foldable material such as fiberboard, creased in a pre-determined pattern for collapsed shipping and easy set-up for filling. The eight vertical side panels of this container are substantially rectangular and equal except for alternately biased fold lines at the bottom of the panels. Diametrically opposite vertical corner edges of the container are provided with longitudinal flaps hinged to one of the two adjacent side panels at that corner, which flaps are about one-quarter or less the width of the panels. These flaps are adhered, such as by an adhesive, to the outer surface of the adjacent panel at that corner, and the hinged foldlines between these flaps and their attached panels are the foldlines which are used when the container is in collapsed or knocked-down position.

The continuous or closed bottom of the container, which is attached by alternate angular foldlines at the base of each side panel, is divided into substantially equal triangular panels by diagonal foldlines between opposite corners of the bottom. Because four of these foldlines intersect at the center, they may be spaced at this intersection so as to prevent weakening the center of the bottom of the container. Opposite adjacent pairs of side panels at their bottom fold edges also have double thickness triangular flaps made of four triangular panels substantially the same as those which comprise the bottom. These flaps, when the container is set-up, are folded inwardly toward each other under the bottom and are fastened to the bottom, either by one or more staples near their adjacent apeces, or by an adhesive, or both.

The single blank from which the container of this invention is assembled, may be coated on at least one side thereof, particularly if the container is to be used for a liquid such as hot asphalt, which coating preferably acts as a barrier and a release for the container after the asphalt has solidified. For example, this coating may be applied in two layers, such as a first layer to fill the pores of the fiberboard from which the container may be made, and the second a silicone composition layer for release of the container from the asphalt that has solidified in the container. Other types of coatings may readily be applied for other purposes for preventing the wetting and/or deterioration of the walls of the container. However, such coatings are not required for some purposes. If a quick- or easy-release coating is provided, it has been found often necessary to skive off this coating from the longitudinal flaps along the vertical sides so as to provide a roughened surface to which an adhesive may be applied for assembly of the container.

The container of this invention may be used for the ball of roots of plants, bushes and trees by nurseries for shipping these plants. Thus the containers may be composed of a sheet material which may be left on the root ball when planted to decompose, and which sheet material may be impregnated with a fertilizer, soil treating and/or plant feeding chemical.

Regarding the single blank from which the container of this invention is folded, this blank comprises generally a substantially rectangular sheet of material opposite ends of which are divided into four separate rectangular side panels by longitudinal equally spaced parallel foldlines that extend the full length of the blank. On each side of the central transverse foldline of the blank is a space to the bottom edges of the side panels which space is about equal to the width of a side panel and is divided by score or foldlines into eight substantially equal right isosceles triangular panels. An important feature of this invention is that the foldlines between the four of these triangles and the bottoms of the side panels at each end of the blank are not parallel to the transverse centerline, but alternately zig and zag about 10° to each other. Furthermore, in order to insure that the two opposite triangular flaps under the bottom have their apeces sufficiently close for a single staple, the foldlines for the bases of these triangular flaps may also be angled slightly with respect to each other. However, this latter center angling of the longitudinal foldlines is not an essential feature of this invention, particularly if these triangular flaps are adhered to the bottom by glue instead of by a single staple between their apeces.

The two longer sides of the blank are provided halfway along each side thereof with a hinged flap about a quarter or less of the width of a side panel. These two flaps are coated with an adhesive and assembly of the blank into a flat pocket or collapsed container position after the blank is folded together along its transverse centerline and these flaps are folded back 180° over the same side edge of the other end of the blank. If the inside of the container or the folded-over side of the flap has been coated, this coating may have to be skived off before the adhesive is applied to insure effective sealing of the sides of the container by the adhesive.

OBJECTS AND ADVANTAGES

It is an object of this invention to produce an efficient, economic, simple, effective leak-proof container from a single piece of folded sheet material.

Another object is to produce such a container which may be knocked-down for shipping in a collapsed or slab-like condition to the place where it is to be filled, and then can be easily and readily set-up for filling with the minimum amount of effort and/or set-up machinery.

Another object is to produce such a container that when it is filled, it is stable and not easily tipped over, is impervious to liquids including hot asphalt, and may be easily stripped or released from its contents.

BRIEF DESCRIPTION OF THE VIEWS

The above mentioned and other features, object and advantages, and a manner of attaining them are described more specifically below by reference to embodiments of this invention shown in the accompanying drawings, wherein:

FIG. I is a perspective view of one embodiment of a container of this invention which has been filled with hot liquid asphalt;

FIG. II is a view of one embodiment of a blank used in forming the container shown in FIG. I;

FIG. III is another embodiment of a blank which may be used in forming the container as shown in FIG. I;

FIG. IV is a plan view of one side of a knocked-down or collapsed container made from either blank shown in FIG. II or III;

FIG. V is a partially set-up container from the blank shown in FIG. IV, showing the bottom triangular tabs or flaps extending outwardly from the bottom thereof;

FIG. VI is a side view of the partially set-up container shown in FIG. V;

FIG. VII is a bottom view of the partially set-up container shown in FIGS. V and VI showing glue spots on its bottom for attaching the bottom triangular flaps or tabs to the bottom of the container;

FIG. VIII is a side view of a set-up container with the bottom triangular flaps folded thereunder and having their apeces stapled to the bottom thereof instead of glued as shown in FIG. VII;

FIG. IX is a bottom view of the assembled container shown in FIG. VIII showing a staple between the apeces of the folded-in triangular tabs or flaps; and FIG. X is an enlarged sectional view along line X—X of FIG. VIII showing how the single staple attaches the apeces of the triangular flaps to the center of the bottom of the assembled container.

DETAILED DESCRIPTION OF THE PREFERRED EMBODIMENTS

Referring first to FIG. I there is shown one embodiment of a container 20 according to this invention filled with a solidified asphalt A that was poured therein while in a hot liquid state. This asphalt as it filled the container tends to bulge the flat side panels thereof to form it into a cylinder from its original octagonally square form as shown in FIGS. VII, VIII and IX. Since the important and unobvious features of the container of this invention are not clearly seen in the container when in its filled condition, reference will now be had to the blank from which the container is made.

Referring now to FIGS. II and III, there are shown two embodiments of a similar single sheet blank 22 or 24 from which a knocked-down or collapsible container according to this invention can be folded or assembled. These blanks 22 and 24, respectively, each comprise eight substantially rectangular side panels 31 through 38, four at each end of the blank 22 and 24, and each panel separated longitudinally by scores or foldlines 41, 42, 43 and 44, 45 and 46 between each group of four side panels 31 - 34 and 35 - 38 at each end of the blanks. These foldlines 41 - 46 extend completely the length of the blank through the central portion thereof, as straight parallel lines in the embodiment blank 22 shown in FIG. II, and with the outer two foldlines slightly centrally bent at 47 and 48 in the embodiment blank 24 shown in FIG. III. In other words, the crease, score or foldlines 41 and 44, 42 and 45, and 43 and 46, are three straight parallel foldlines extending the full length of the blank 22 in FIG. II, while the two outer pairs of longitudinal foldlines 41 and 44, and 43 and 46 in the blank 24 in FIG. III have straight inwardly bent foldlines 47 and 48.

Transverse of the center of both blanks 22 and 24 is a straight score or foldline 50 and on each side thereof spaced about the distance of the width of each of the side panels 31 through 38 are the bottom foldlines 51 through 58, respectively, for the folded-in triangular bottom panels of the container 20 from the bottom edges of these side panels 31 through 38. These foldlines 51 through 54 and 55 through 58 form two slightly zig-zag lines substantially parallel to the center foldline 50 which zig and zag angularly alternately with respect to each other about 10°, plus or minus about 5°, as indicated by the angle $\alpha$ in FIG. II. The purpose of these zig-zag bottom foldlines 51 through 58, is to insure that the carton when erected will rest stably on its outer bottom lower four corner edges between foldlines 51-52, 53-54, 55-56, and 57-58, and thereby provide ample space between these bottom corners for the folded-in bottom triangular tabs or flaps 81 and 82 (see FIGS. V through X) without causing rocking or tilting of the container 20. Each of the substantially square squares formed by the scores or foldlines 41 through 48 and 50 through 58 at the base of each of the side panels 31 through 38 are further creased or scored with a single diagonal 61 through 68, so that these diagonals form two larger squares with one of their diagonals on the center foldline 50 and each containing four triangular panels, which in the embodiment of FIG. II are four isosceles 45° right triangles, while in the embodiment of FIG. III are slightly distorted by the angular offset foldlines 47 and 48 of the central portions of the longitudinal foldlines 41, 44 and 43, 46.

In addition to the eight substantially rectangular side panels 31 through 38 and the sixteen substantially triangular central bottom panels, each blank 22 or 24 is provided with a pair of flaps 71, 72 in FIG. II which may be joined by heavier foldlines 73 and 74 to the side panels 31 and 34 respectively, and extend beveled from the center transverse foldline 50 to the outer or upper end of the blank 22 or container 20. In the event that the surface of the blank shown in FIG. II is a coated surface, such as with a quick release coating, it is desirable that this coating be skived off of at least the major central portion of each of these flaps 71 and 72 so that an adhesive 75 can be applied thereto for the assembly of the carton of the knocked-down or collapsed position or form shown in FIG. IV by the folding-over of these flaps 71 and 72 and adhering them onto the opposite uncoated sides of the panels 35 and 38, respectively. However, instead of placing the flaps 71 and 72 both at the same end of the blank 22 as shown in FIG. II, they may be shown at opposite ends and on opposite sides of the blank 24 like flaps 71 and 76 in the embodiment shown in FIG. III, which configuration permits the blanks 24 to fit better for nesting into a larger sheet. The flap 76 is similarly connected by a score line 78 to the outside of the panel 38. It is to be understood, however, that the flaps 71 and 76 shown in the embodiment of the blank 24 also may be coated and skived as the flaps 71 and 72 in FIG. II, and that the central portions of the elongated foldlines 41, 44 and 43, 46 in FIG. II may be offset as foldlines 47 and 48 in FIG. III, without departing from the scope of this invention.

When the slab-like, flat or knocked-down container or carton 20 according to this invention and shown in FIG. IV is to be set-up, the first stage is to spread it open in the form shown in FIGS. V through VII in which the central eight triangular panels of the bottom form a bulged side square or octagon (see FIG. VII) and the eight side panels 31 through 38 form an eight-sided hollow open top prism (see FIGS. V and VI). The other four bottom triangular panels on each side of the blanks 22 or 24 form two double-size triangular flaps 81 and 82, extending downwardly from the two opposite pairs of side panels 31, 35 and 34, 38. The next step in assembly of the carton is to fold these two triangular flaps 81 and 82 of double-thickness fiberboard inwardly over the bottom as shown in FIGS. VIII and IX, which flaps 81 and 82 preferably are adhered to the bottom, such as by an adhesive shown in spots 83 and 84 in FIG. VII, and/or by the means of one or more staples 85 shown in FIG. VIII, IX and X. The purpose of the bent folds 47 and 48 is to enable the bottom flaps 81 and 82 to fold inwardly sufficiently that their apeces are close enough together to be fastened by a single staple 85. It is to be understood that the glue spots and/or staples may be applied in a special set-up machine, if desired. However, there is no separate side, wall, bottom, part or panel of the carton of this invention which needs to be added to the basic blank or knock-down carton in order to assemble it for use as has been required for asphalt drum cartons in the prior art.

While there is described above the principles of this invention in connection with specific articles, it is to be clearly understood that this description is made only by way of example and not as a limitation to the scope of this invention.

I claim:

1. A drum-shaped container composed of a single sheet of foldable material comprising:

(A) eight vertical equal and substantially rectangular side panels forming an octagonal prism with an open top and a closed bottom, (B) a pair of flaps at diametrically opposite corner edges of said prism, each flap being attached to one side panel and overlapping and attached to the adjacent side panel, (C) alternate straight angular upwardly and downwardly foldlines between the bottom of each side panel and the bottom of the container, which angles of adjacent foldline are about 10° with respect to each other, (D) eight triangularly shaped panels separated by creases diagonally from each corner of the octagon forming said bottom, (E) two opposite triangular double-thickness flaps hinged to the bottom edges of opposite adjacent pairs of said panels and folded under said container against said bottom, and (F) means for fastening said two opposite triangular double-thickness flaps to said bottom.

2. A container according to claim 1 wherein said foldable material is a fiberboard.

3. A container according to claim 1 wherein said foldable material is coated with a quick-release coating.

4. A container according to claim 1 wherein said fastening means comprises an adhesive.

5. A container according to claim 1 wherein said fastening means comprises a staple between the apeces of said two opposite triangular double-thickness flaps.

6. A drum formed of a single sheet of foldable material, said drum comprising:

(A) eight vertical equal and substantially rectangular side walls, (B) an open top, and (C) a closed substantially square octagonal bottom comprising:

(1) eight triangular panels formed by diagonal foldlines bisecting the angle between the bottom edges of adjacent side walls, the straight foldlines between these triangles and their adjacent side walls alternately angling upwardly and downwardly about 10°, (2) a pair of triangular flaps hinged to opposite sides of said substantially square bottom with their apeces at the center of said square, and (3) means for fastening said triangular flaps to said square.

7. A drum according to claim 6 wherein said foldable material is a fiberboard.

8. A drum according to claim 6 wherein said foldable material is coated with a quick-release coating.

9. A drum according to claim 6 wherein said fastening means comprises an adhesive.

10. A drum according to claim 6 wherein said fastening means comprises a staple between the apeces of said two opposite triangular double-thickness flaps.

11. A drum according to claim 6 including a pair of vertical side flaps diagonally opposite each other for holding opposite edges of said single sheet together to form said drum.

12. A blank for forming a drum comprising a substantially rectangular sheet of foldable material scored into:

(A) eight longitudinal side panels, four parallel to each other at each end of said blank, (B) a central section of sixteen substantially equal triangular panels which join the adjacent ends of alternate adjacent pairs of the side panels at obtuse angles, and (C) side flaps along each side of half the length of said blank.

13. A blank according to claim 12 wherein said foldable material is fiberboard.

14. A blank according to claim 12 wherein said foldable material is coated on one side thereof.

15. A blank according to claim 14 wherein said coating on said flaps is skived-off for an adhesive.

16. A substantially rectangular coated fiberboard blank for forming an asphalt drum when folded along the straight score lines in said blank, said score lines comprising:

(A) three equally spaced score lines extending the full length of said blank forming eight substantially rectangular and equal side panels, four of said side panels at each end of said blank; and one panel on each side of said blank having longitudinal flap therealong extending from the center of said blank to its end, (B) a transverse central score line;

(C) a pair of slightly zig-zag complementary score lines along each side of said central score line and spaced therefrom substantially the width of said panels to form eight substantially square squares; and (D) diagonal score lines in each of said eight squares to form two squares each having a corner at the center of said blank and said central score line forming a diagonal successively across each of said two squares.

17. A collapsed drum-shaped container composed of a single sheet of foldable material comprising:

(A) two equal and parallel rectangular composite panel sections folded together along one common edge thereof centrally of said sheet, said composite panel sections being held together along two opposite other edges thereof by integral overlapping adhered flaps to form a closed pocket, each of said composite panel sections comprising:

(a) four substantially rectangular parallel equal panels which form the sides of the octagonal-shaped prism container when set-up, and (b) eight triangular panels separated by score lines, two triangular panels at the bottom end of each side panel and forming a substantially square section, and (c) the adjacent foldlines between the triangular panels and their adjacent side panels being at an angle with respect to each other of about 10° to form a zig-zag foldline at the bottom end of each of said four side panels.

18. A container according to claim 1 wherein said foldable material is a fiberboard.

19. A container according to claim 1 wherein said foldable material is coated with a quick-release coating.

* * * * *